US007269935B2

(12) United States Patent
Jafari

(10) Patent No.: US 7,269,935 B2
(45) Date of Patent: Sep. 18, 2007

(54) WRAPPING APPARATUS FOR WRAPPING LOAD WITH FLEXIBLE FILM AND BANNER FILM

(75) Inventor: Behzad A. Jafari, Schaumburg, IL (US)

(73) Assignee: Arpac, L.P., Schiller Park, IL (US)

( * ) Notice: Subject to any disclaimer, the term of this patent is extended or adjusted under 35 U.S.C. 154(b) by 0 days.

(21) Appl. No.: 11/383,737

(22) Filed: May 16, 2006

(65) Prior Publication Data

US 2006/0260279 A1 Nov. 23, 2006

Related U.S. Application Data

(60) Provisional application No. 60/681,685, filed on May 17, 2005.

(51) Int. Cl.
*B65B 13/04* (2006.01)

(52) U.S. Cl. ..... 53/588; 53/176; 53/210; 53/556

(58) Field of Classification Search ..... 53/135.3, 53/170, 171, 172, 176, 210, 218, 441, 449, 53/465, 556, 588
See application file for complete search history.

(56) References Cited

U.S. PATENT DOCUMENTS

| | | | | |
|---|---|---|---|---|
| 5,107,657 | A * | 4/1992 | Diehl et al. | 53/588 |
| 5,409,177 | A | 4/1995 | Parry et al. | |
| 5,421,141 | A * | 6/1995 | Gordon | 53/588 |
| 5,423,163 | A * | 6/1995 | Wendt | 53/588 |
| 5,749,206 | A * | 5/1998 | Moore et al. | 53/588 |
| 5,875,617 | A * | 3/1999 | Scherer | 53/588 |
| 6,170,233 | B1 * | 1/2001 | Marois et al. | 53/588 |
| 6,219,992 | B1 | 4/2001 | Maki-Rahkola et al. | |
| 6,311,459 | B1 * | 11/2001 | Rossi | 53/556 |
| 6,393,808 | B1 | 5/2002 | Kallner et al. | |
| 6,453,643 | B1 * | 9/2002 | Buscherini et al. | 53/588 |
| 6,910,315 | B2 * | 6/2005 | Suolahti | 53/176 |
| 2004/0055252 | A1 | 3/2004 | Suolahti | |

* cited by examiner

*Primary Examiner*—Louis Huynh

(57) ABSTRACT

An apparatus for wrapping a pallet load having a rotary swing arm carrying two upright towers, each tower having a film carriage mounted to and movable along the upright tower for holding a roll of flexible stretchable film and a roll of relatively unstretchable banner film, a programmable control logic controls the wrapping machine to wrap the pallet load with the flexible stretchable film, then over-wrap with the relatively unstretchable banner film over the wrapped flexible stretchable film, and then continue to over-wrap the wrapped relative unstretchable banner film with the flexible stretchable film.

13 Claims, 6 Drawing Sheets

WRAPPING APPARATUS FOR WRAPPING LOAD WITH FLEXIBLE FILM AND BANNER FILM

CROSS-REFERENCE TO RELATED APPLICATIONS

This application claims the benefit for priority purposes of U.S. Provisional Patent Application Ser. No. 60/681,685 filed May 17, 2005, and entitled "WRAPPING APPARATUS FOR WRAPPING LOAD WITH FLEXIBLE FILM AND BANNER FILM," which is incorporated by reference herein.

FIELD OF THE INVENTION

An apparatus for wrapping packages with flexible stretchable film and an unstretched banner film, both the stretch film and banner film are supplied on separate rolls. The apparatus comprises a support frame, a swing arm rotatable on the frame defining a circular path around a vertical axis. The support frame extends across a conveyor belt to clear a load being wrapped. Two film carriages mounted upon the main tower and the auxiliary tower for conjoint movement with the swing arm, each carriage to support a roll of flexible film and a roll of less flexible unstretched banner film with each axis parallel to the vertical axis of the swing arm. The support for each film carriage is a lift integrated into each tower. The film carriages are movable along the vertical path on each tower. Each tower and film carriage arrangement also revolves around the load to be wrapped about the vertical axis of the support ring. The flexible stretch film wraps the load including its support that is the container and the pallet. At a programmed point in the wrapping sequence, the unstretched banner film is wrapped over the flexible stretch film. The unstretched banner film is then over wrapped with the flexible stretch film, creating a wrapped load with a wrap around banner label visible through the flexible stretch film.

This invention, accordingly, provides an apparatus for wrapping a stationary pallet load with flexible film and the flexible over-wrapping film with a relatively unstretchable banner film, which is then over-wrapped with stretchable film. The prior art methods utilized a printed stretch film in conjunction with stretch film dispensing device. This method is generally unsuitable since the stretch film distorts the logo and other printed material rendering the writing useless. This invention provides an apparatus for wrapping a load with flexible stretch film and overwrapping the flexible stretch film with unstretched banner film and then over-wrapping the unstretched banner film with the flexible stretch film, which results in a wrapped load wherein the graphics on the banner film are not distorted.

It is an object of this invention to provide an apparatus for wrapping a pallet load having vertical sides and upper edges defining upper corners and lower edges defining lower corners with a flexible stretchable film over-wrapped with a relatively unstretchable unstretched banner film wherein the banner film is then over-wrapped with the flexible stretchable film.

The apparatus, in combination, comprising:

(a) conveyor for supporting the pallet load in an elevated position, in which each corner of the pallet load is exposed, (b) a support structure disposed in a fixed position above the pallet load, (c) one rotary wrapper swing arm with two downward projected towers supported by the supporting structure, said swing arm rotatably driven about a vertical axis of the pallet load, the rotary swing arm disposed above the pallet load in a rotatable position of the rotary swing arm, (d) the downward projected two downward towers supported from the rotary swing arm outwardly spaced from the pallet load in a rotatable position of the rotary swing arm, (e) film supply devices mounted on each of the two downward projected towers, each driven in an upward direction and downward direction on said towers, (f) electric motor for driving the rotary swing arm rotatably about one vertical axis in such a manner that said towers sweep a path around the pallet load, (g) guidance device for causing the applied film to move selectively in an upward direction and in a downward direction as the swing arm rotates, (g) hot wire cutting device to cut the flexible film as a film sheet intended to wrap and secure a pallet load, (i) hot wire cutting device to cut the relatively unstretchable unstretched banner film as a film sheet wherein the banner film remains at full width, (j) clamping device for holding the banner film, (k) attaching device for attaching the heat sealable banner film to the stretch film, (l) forming a compressed rope of flexible film to form a tail, (m) twist tie device or metal ring device for mechanically securing the tail of the flexible stretchable film to the load, and (n) a programmable logic controller (PLC) to control said apparatus and connected to said supply device for the flexible film, said supply for the less flexible banner film, said rotating wrapper swing arm electric motor, said applicator for dispensing the flexible film as a film sheet, said applicator for dispensing the relatively unstretchable unstretched banner film as a film sheet, said clamping device for holding the banner film, said attaching device for attaching the banner film to the stretch film, said twist tie device or metal ring device for mechanically securing tail of flexible stretchable film to the load.

The flexible film is a polyolefin, preferably polyethylene unstretched under operating conditions typically used in securing pallet loads of product with stretch wrap apparatus.

The banner film is an unstretched polyolefin, preferably polyethylene wherein under operating conditions the printed banner film is unstretched. The banner film is a low-density polyethylene blend monolayer. In Table 1 are set forth the physical properties of the banner film.

TABLE 1

| | | | |
|---|---|---|---|
| Gauge | | Inches | 0.0015 |
| Tensile Strength At Break | MD | | 4600 |
| | TD | | 4400 |
| Elongation At Break | MD | % | 700 |
| | TD | % | 750 |
| 1% Secant Modulus | MD | | 28000 |
| | TD | | 32000 |
| Dart Impact | | grams | 190 |
| Elmendorf Tear | MD | grams | 230 |
| | TD | grams | 350 |
| Haze | | % | 9–12 |
| COF | | | 0.30 |

Another object is in providing a method for wrapping a stationary pallet load with a flexible stretch film and over-wrapping with a relatively unstretchable unstretched banner film wherein the banner film remains at full width and the over-wrapping the banner film with the flexible film said method comprising:

(a) wrapping the load with a flexible film and once the load has been wrapped discontinuing the flexible film wrapping, and
(b) commencing banner film application by attaching the unstretched banner film to the wrapped flexible film with suitable attachments including heat and mechanical devices, and
(c) over-wrapping the flexible film with one rotation around the load with the unstretched banner film in which the banner film remains at full width, and
(d) attaching the tail of the banner film to the load and severing the tail of the banner film from the supply side,
(e) over-wrapping the banner film with the flexible film,
(f) converting the flexible film web into two strands of a rope film,
(g) securing the first rope to the load, and
(h) clamping and severing the second rope and holding it in position for the next wrapping cycle.

Another objective is to provide a wrapping apparatus for wrapping load with flexible film and banner film on which are printed graphics which comprises applying unstretched banner film on the load wrapped with flexible stretch film without distorting the graphics on the banner film and converting flexible film into rope film and securing the rope film to the load to prevent the unwrapping of the load.

Description of the Prior Art making a unitized package of multiple containers of multiple products stacked upon a pallet or single items on a pallet or multiple products or single products not on a pallet for ease of transportation and handling. The wrapping material is usually heat shrinkable, stretchable plastic film. The ends of the wrapping material are secured to the unitized package to maintain the security of the package by preventing the undoing of the wrap in shipment or storage. Plastic film and netting of stretch and heat shrinkable characteristics offer aesthetic and visual advantages in that the interior content of the wrapped package can be viewed through suitable plastic film for visual inspection.

This invention in one aspect is directed to an apparatus for wrapping a heavy load with flexible film, over-wrapping with a less flexible banner film which retains its original width on the large loads consisting of cement blocks, bricks, and related products and overwrapping the banner film with the flexible film.

In this invention the banner film is attached by heat or another device to the flexible film wherein only one layer of the banner film is over-wrapped around the load with the banner film retaining its original width. The wrapping is completed by over-wrapping the banner film with the flexible film. The prior art uses printed stretch film to display the graphics. This method is inadequate since the printed stretch film distorts the graphics when stretched. This apparatus attaches the banner film to the flexible film not as in the prior art wherein stretch film is utilized to secure the banner film to the load.

Some representative prior art is discussed herein but these references do not suggest or disclose the problem solved by the instant invention.

U.S. Patent publication 2004/0055252 A1 to Suolahti discloses a wrapping machine wherein two films are wrapped on a load, wherein the two films are in contact with each other during the wrapping process. The first transparent film is stretched and the second film carries the logo or other writing on it. This prior art apparatus, accordingly, operates in a different manner from the inventive apparatus. The apparatus of this invention provides for applying the flexible film on a film sheet and selectively as a film rope in which the wrapping film is punched into a rope line configuration.

The inventive apparatus of this instant invention provides for applying the relatively unstretchable banner film as a film sheet in which the banner film remains at full width. Attaching devices are provided for attaching the banner film to the stretch film and a roping device is provided to form a rope of the banner film to secure it to the load and a twist tie device or metal ring device for mechanically securing the tail of the flexible stretch film to the load. Thus the inventive apparatus of the instant invention differs from this prior art reference and is an improvement over the reference.

U.S. Pat. No. 6,393,808 B1 to Kallner et al., discloses a label film application mechanism. The invention uses a vacuum bar adjacent to the flow parts of the stretch wrap film and defining a vacuum effect force for retaining a leading end portion of said label film upon said vacuum bar. It is clear that this prior art reference discloses an apparatus, which is different from the inventive apparatus. An apparatus having a vacuum system may have a questionable operability compared to the apparatus of this invention.

U.S. Pat. No. 5,409,177 to Parry et al., relates to a hand-held stretch film wrapper for wrapping a stack of articles on a pallet and to apply a number of narrow auxiliary bands on which terms such as "Happy Mother's Day" are printed. This prior art apparatus discloses a manual process instead of an electrically controlled process.

U.S. Pat. No. 6,219,992 B1 to Maki-Rahkola et al., shows a device used in conjunction with a wrapping device comprising a reel of labels that are applied to a wrapping film to wrap an article. This prior art reference illustrates the state of the prior art but is unrelated to the inventive apparatus claimed herein.

SUMMARY OF THE INVENTION

This invention provides an apparatus for wrapping a pallet load with a flexible stretched film and over-wrapping the flexible film with a banner film which is unstretched under operating conditions of the inventive apparatus and over-wrapping the unstretched banner film with the flexible film. There has been a long felt need for manufacturers and vendors of these products to attach their proprietary graphics to the wrapped product. Prior to this invention this was hard to accomplish since the stretch film distorts the graphics and makes them unintelligible or unattractive in other ways.

This invention provides an apparatus which first wraps the load with the flexible film and over-wraps the relatively unstretchable unstretched banner film on which the corporate graphics are found. Once the stretch film has covered the surface of the large load the wrapper swing arm has been programmed to stop for label film application. The start of the over-wrapping with the banner film commences with the attaching of the banner film to the stretch film that is on the load. After one rotation the swing arm stops and label application device attaches the tail of the banner film to the load and cuts the attached part from the supply side and retracts to clear the load. The apparatus is programmed so the flexible film over-wraps the unstretched banner film.

The apparatus of this invention is particularly suitable for wrapping the load with flexible stretch film over-wrapping the flexible film with the less flexible unstretched banner film and overwrapping the banner film with the flexible film. The heavy loads can comprise any product that can be suitably wrapped on stretch wrap apparatus. The apparatus is however suitable for wrapping with flexible film and over-wrapping with banner film loads of various sizes. The programmable logic controller (PLC) control system will adjust the apparatus so that levels of various sizes can be serviced.

The load is conveyed to reach the wrap zone on the process conveyor. Photo eyes detect the load and signal the conveyor to stop. Variations of the load length are accommodated by having the PLC determine the size of the load and adjust the wrapper swing arm, the film supply and related equipment to the size of the load to be wrapped and the stopping position of the load. The lateral position of the load is adjusted by using the "pop-up" conveyors within the process conveyors.

The apparatus of this invention provides for the wrapping of a large load with the flexible film, applying the unstretched banner film to the flexible film and then covering the load and the banner film with a flexible film. An important aspect of the inventive apparatus is that it provides for a mechanical fastening and binding process that secures the flexible stretch film to the load once the wrap of the load is complete. The mechanical fastening process applies a mechanical metal ring (Hog Ring) fastener or twistable fastener as a tie to secure the tail of the flexible film to the load in one final winding wrap cycle of the wrapping process. The term "tail" refers to the material tail that results from a roll of flexible film after wrapping a load with flexible film and the flexible film web is cut by a cutting mechanism. The flexible film tail needs to be secured to the load or the wrap can come undone in shipment or storage.

The apparatus of this invention besides applying the stretched film and the unstretched banner film to the load also forms a compressed rope from the flexible film tail after the load is wrapped with the flexible film. The flexible film rope is tied using a mechanical fastener as a twistable tie or metal ring mechanism (not shown) applied to the flexible film rope fashioned from the flexible film web. The flexible film fastening apparatus and method is controlled by the programmable logic controller (PLC) control system.

DETAILED DESCRIPTION OF THE EMBODIMENT

Figure 1:
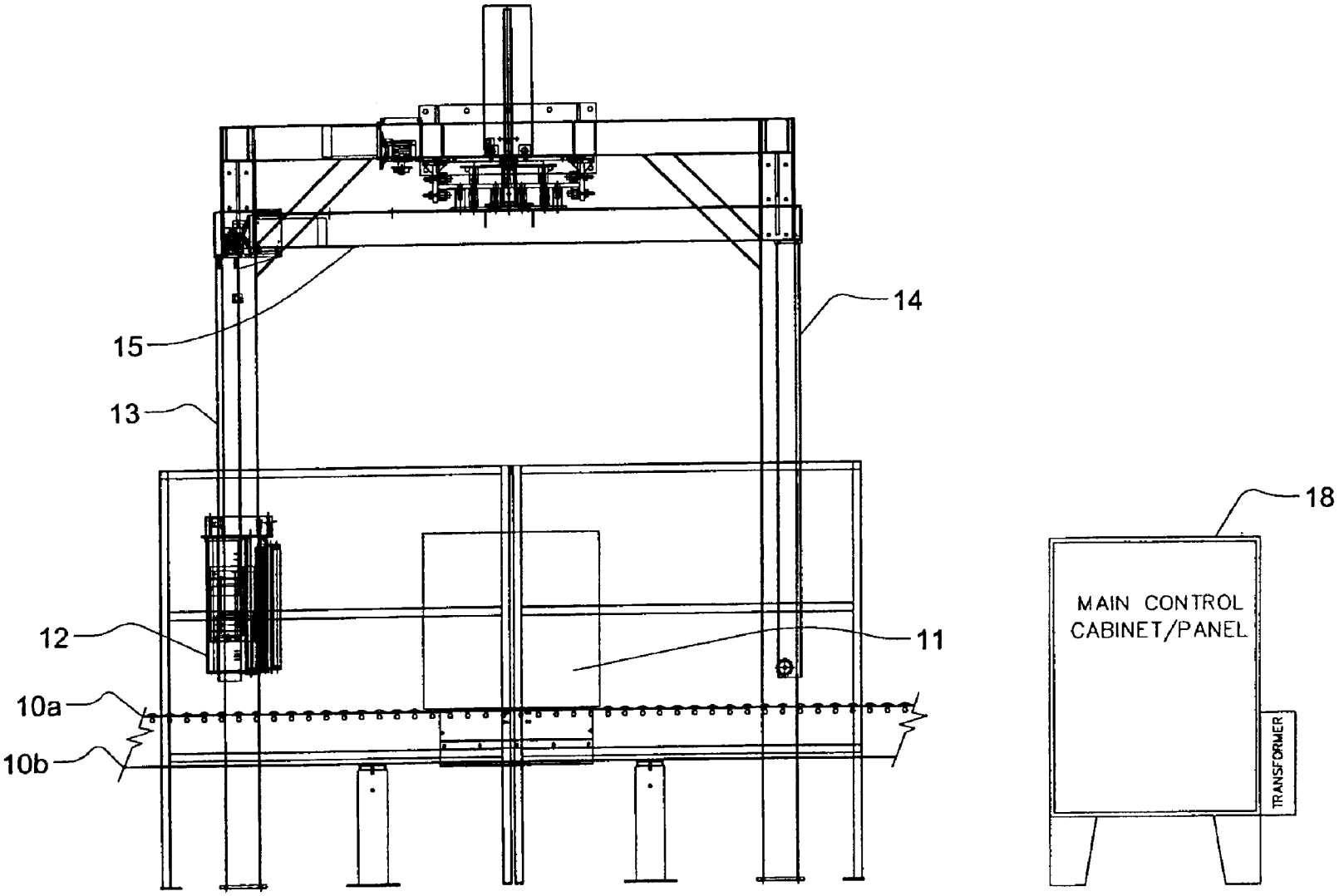
FIG. 1 is a side view of an apparatus of the preferred embodiment of the invention including the control panel.
Figure 2:
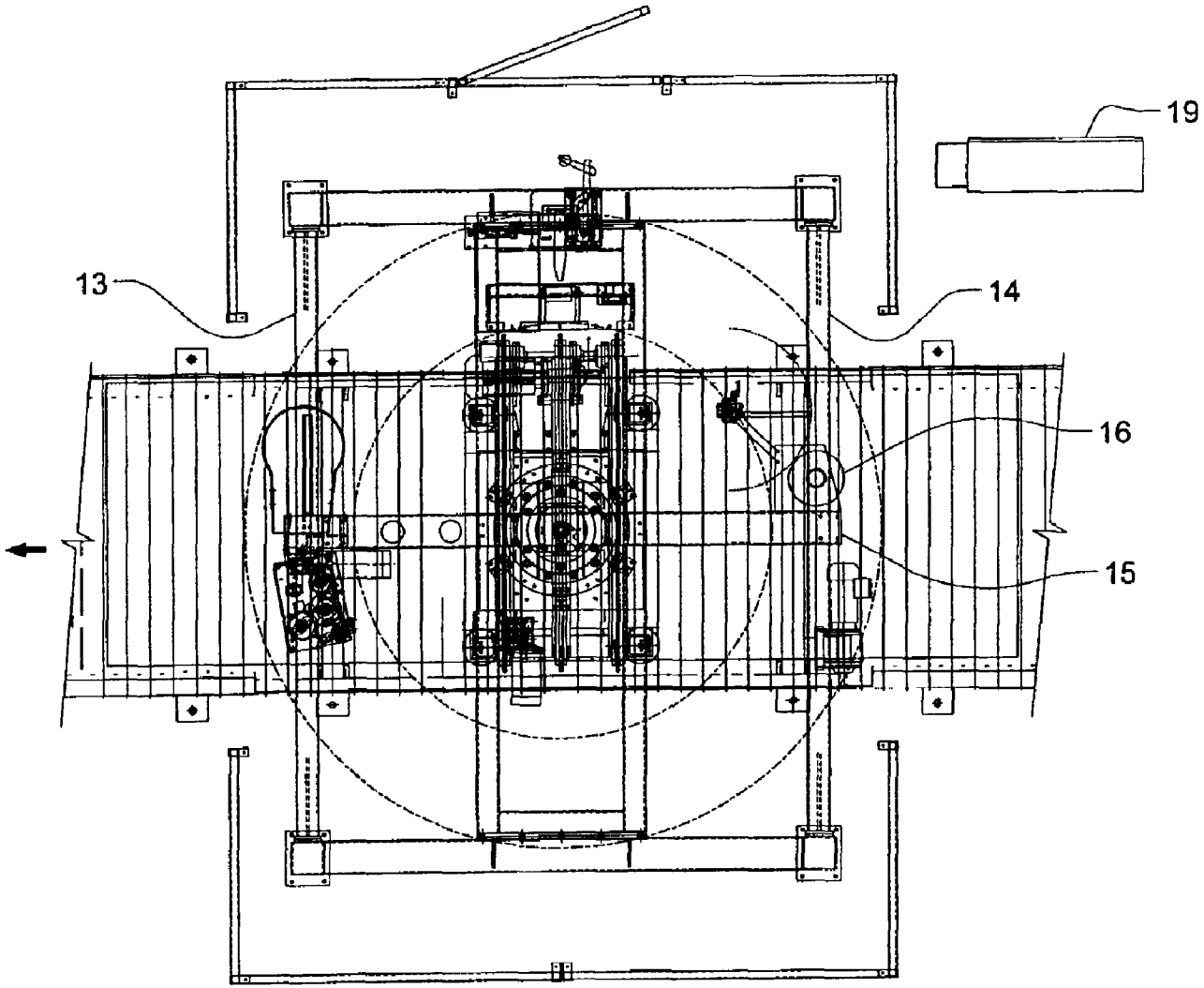
FIG. 2 is a top view of an apparatus of the preferred embodiment of the invention including the remote control panel.

Referring to FIGS. 1 and 2, the apparatus of the present invention includes a conveyor belt 10*a* on a conveyor structure 10*b*. On the main tower 13 is mounted an applicator structure 12 including a roll of flexible material and the applicator. Applicator structure 12 carries a roll of flexible film. The banner film applicator structure 16 is located on auxiliary tower 14 and carries a roll of the less flexible banner film. FIG. 1 also shows a main control panel 18. FIG. 2 also shows remote control panel 19.

The roll of flexible film is mounted rotatably on flexible film applicator structure 12 on tower 13. The structure roll of the less flexible banner film is mounted rotatably on the banner film applicator structure 16 on tower 14. Large load 11 usually comprising pavers, bricks, cement blocks or lumber is conveyed into a wrapping area by the conveyor 10*b* on conveyor belt 10*a*.

The apparatus includes a device for effecting relative movement between the load 11 and the flexible film structure 12 in order to wrap the load with the flexible film, to attach the banner film and over-wrap it once around the load 11 which has been wrapped with the flexible film and then over-wrapping the banner film with the flexible film. The structure 12 including the flexible film applicator for the flexible film is mounted on main tower 13 supported on swing arm 15, the swing arm 15 being rotatably mounted on the apparatus frame. The supply roll of the banner film is mounted on the banner film applicator structure 16 on swing arm 15, swing arm 15 being rotatably mounted on the auxiliary tower 14. Relative movement between the load 11 and the flexible film supply applicator 12 is effected by rotating the swing arm 15 around the load 11 many times. The movement between the stationary load 11 and the less flexible banner film supply applicator structure 16 is effected by rotating the swing arm 15 one full round around the circumference of the load 11. After applying the banner film to the flexible film, the flexible film applicator is then rotated to apply the flexible film to the banner film.

The wrapping operation is initiated by moving the load on the conveyor 10*b*, to a wrap zone. Photo eye (not shown) detects the load 11 and signals, the conveyor 10*b* to stop since it has reached the wrap zone. As soon as the load 11 is situated in the wrap zone the wrapping process begins. The flexible film applicator 12 is directed to supply the flexible film from supply roll to wrap the load 11 engaging the rotatable swing arm 15 and the flexible film applicator 12 mounted on the main tower 13.

As soon as the load 11 has been wrapped by the flexible film applicator 12, the banner film which is held by a clamp device (not shown) is then applied by banner applicator structure 16 to the flexible film. The programmable logic controller (PLC) then directs the less flexible, unstretched banner film applicator structure 16 to attach the banner film to the load 11, wrapped by the flexible film in one rotation, by rotating the rotatable swing arm 15 and the banner film applicator structure 16 located on the auxiliary tower 14. After this one rotation the banner applicator structure 16 attaches the tail of the banner film to the load 11. The banner applicator structure 16 then cuts the tail from the roll of banner film applicator structure 16 by hot wire-cutting device (not shown). The banner film applicator structure 16 then retracts to clear the load 11.

The wrapping cycle continues. The supplying device is directed to supply the flexible film from applicator 12 to over-wrap the unstretched banner film from applicator structure 16. When the flexible film applicator 12 has reached the bottom of load 11, the stretch film from applicator 12 is converted into a rope by a cylindrical rope making device (not shown). Once two strands of the film rope are accumulated, twist tie wire device or metal ring fastener device is applied by the twist wire or metal ring control system mechanically securing the tail of the film to the load 11. At this time the trailing portion of the film rope is clamped by clamping device, cut by cutting device, and held in position for the next wrapping cycle.

Upon start of a subsequent cycle, a pneumatic air cylinder (not shown) will carry the clamped tail of the film rope to the trailing side of the twist wire or metal ring control system to ensure that no tail from the roping operation is left out from the wrapping sequence.

Figure 3:
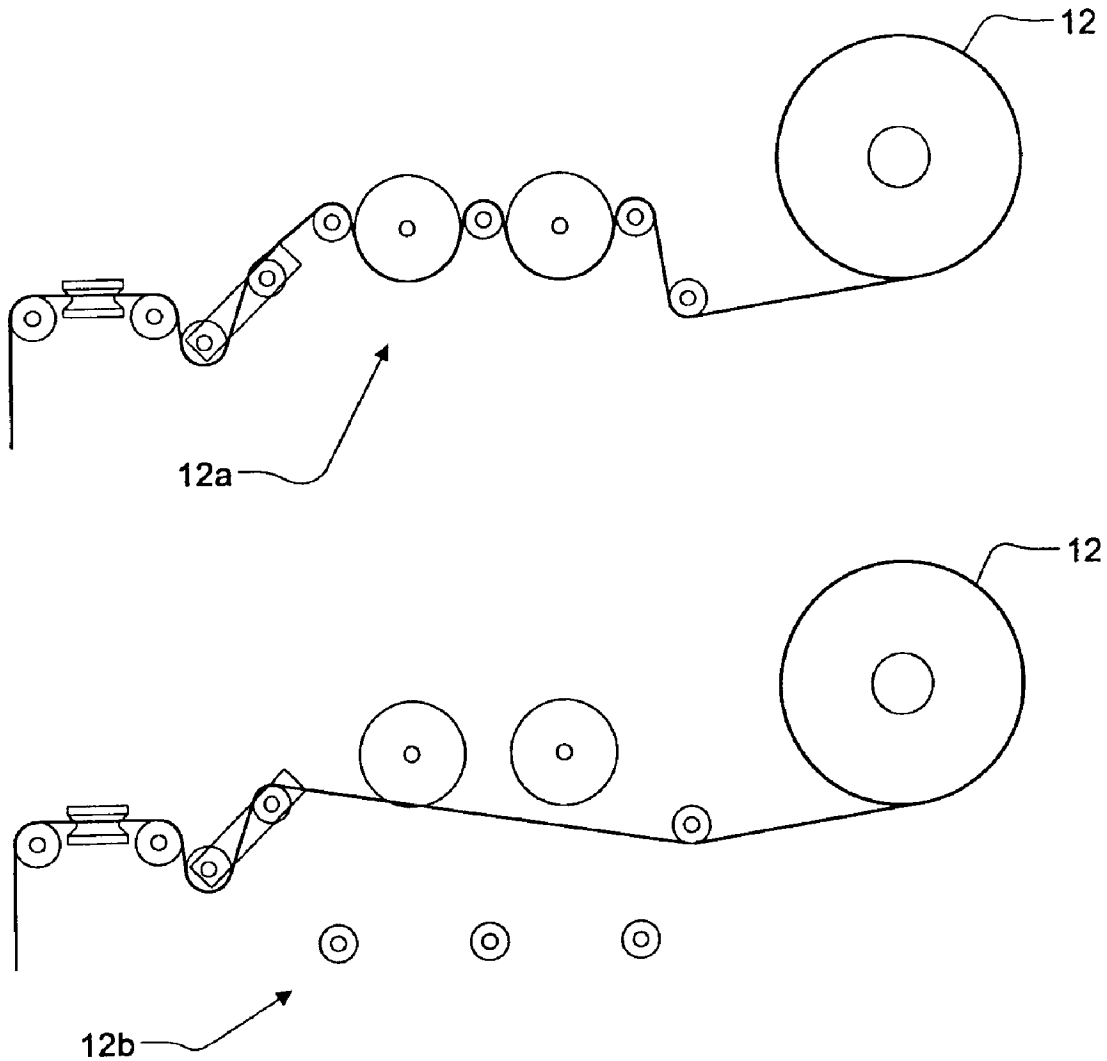
FIG. 3 is a side view of a film-threading dispenser for the flexible stretch film supply showing when the door is open and closed.

FIG. 3 shows operation of the film-threading diagram for the flexible stretch film applicator structure 12 of FIG. 1. Under the operating conditions of the apparatus of this invention the stated film is stretched. FIG. 3 shows that when the unstretched flexible film is used for wrapping the load, stretching door 12*b* is open as controlled by the PLC. When the unstretched banner film is applied, stretching door 12*a* of the stretching mechanism is closed as controlled by the PLC to stretch the film.

Figure 4:
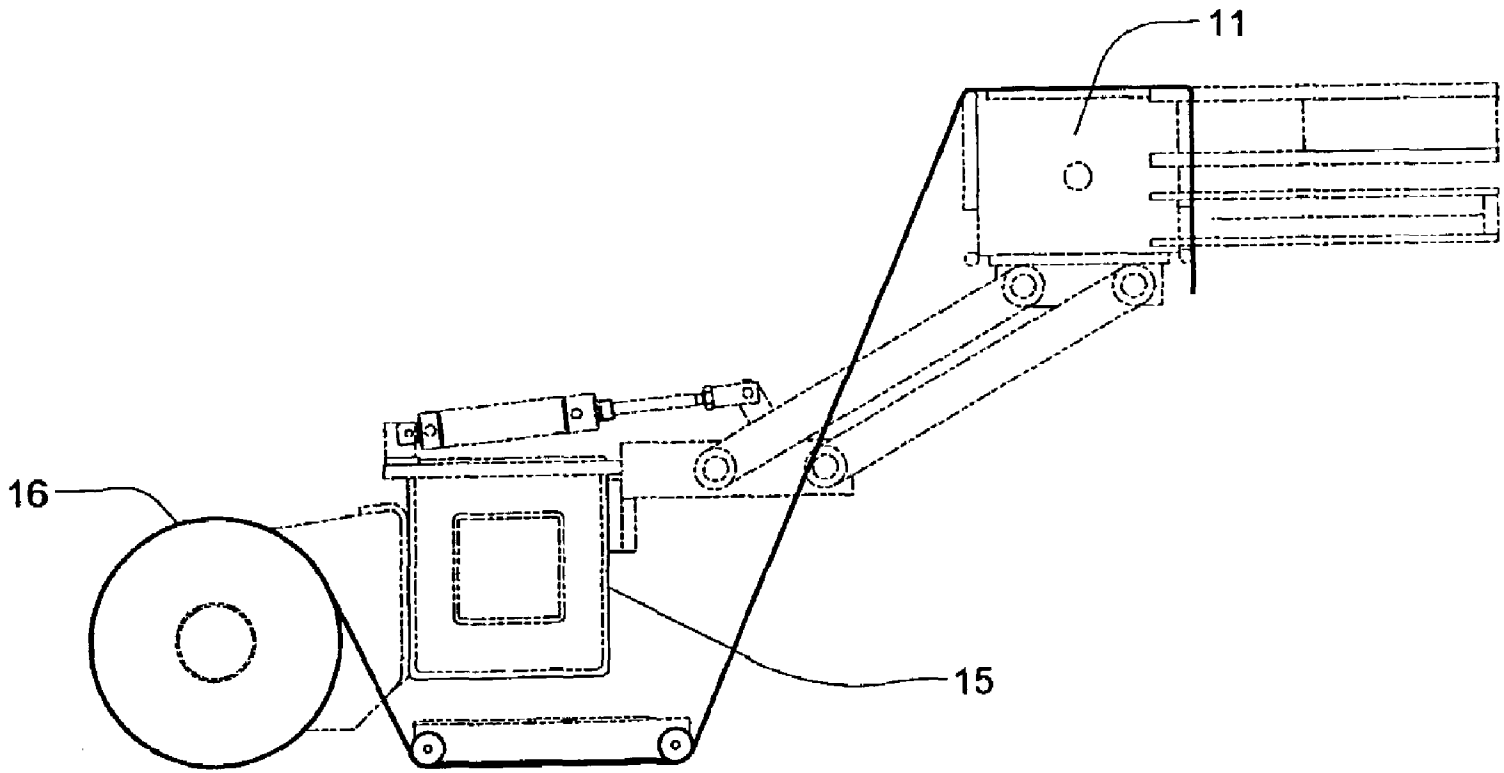
FIG. 4 is a top view and a side view of an unstretched banner film-threading dispenser.

FIG. 4 illustrates the unstretched banner film applicator structure 16 on FIG. 2 threading the banner film around a swing arm 15. Structure 16, including the banner film roll on banner film applicator on auxiliary tower 14, is rotated once around the load 11.

Figure 5:
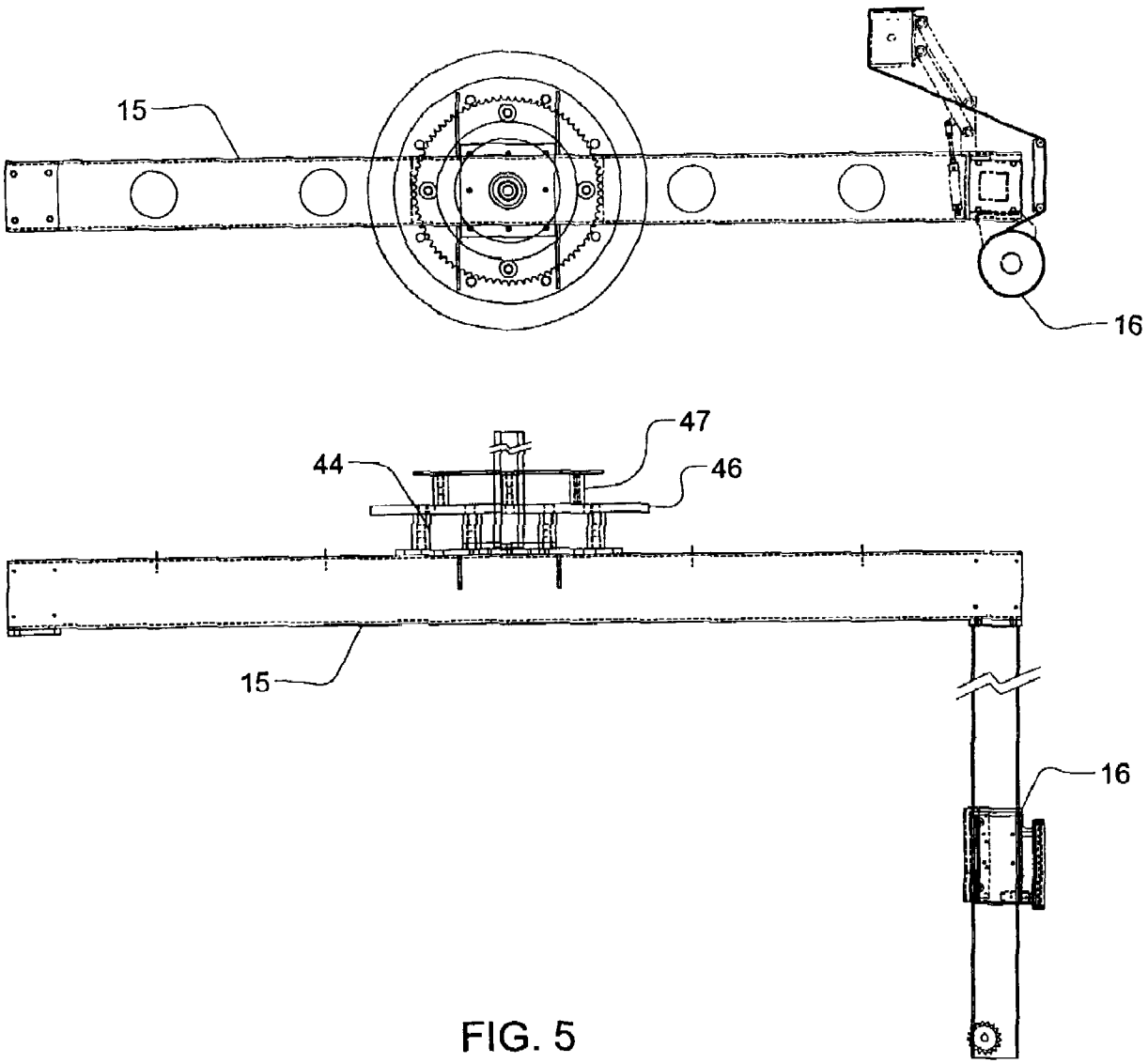
FIG. 5 is a side view of the arm swing.

FIG. 5 is a top view of swing arm 15 with support structure 16 including banner roll and banner applicator structure 16, wherein 44 indicates 8 spaces, 46 indicates the guide ring, 47 indicates 4 rods. After one rotation of the banner applicator and roll 16 around the load 11, the support structure 16 attaches the tail of the banner film from support structure 16 to the load 11. The support structure 16 attaches the tail of the banner film of the roll of banner applicator and roll 16. The banner applicator and banner applicator roll 16 structure cut the attached part from the banner applicator and banner roll 16. The banner film applicator and banner roll 16 structure retract to clear the load 11.

Figure 6:
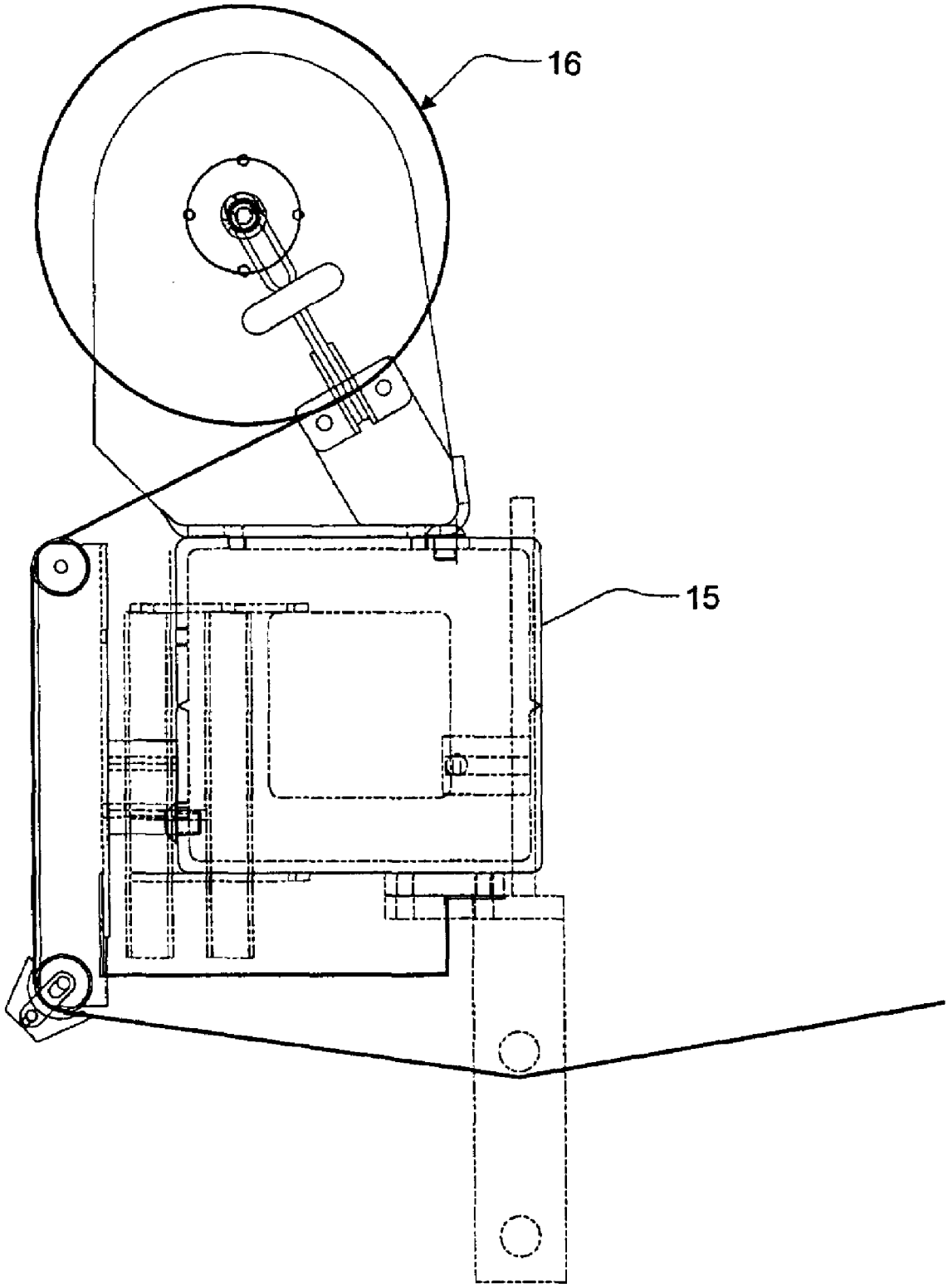
FIG. 6 is a top view of the film carriage roll. This type of film carriage is used for both flexible film and the unstretched banner film. One carriage roll is shown but two are used in operation of the apparatus.

FIG. 6 is a side view of the structure 16 as shown in FIG. 2 wherein the roll is shown in front view.

PLC controller 18 initiates the wrapping process of the load with the flexible film from roll, the attachment and one rotation of over-wrapping the load with unstretched banner film from roll of banner film. The banner film does not change its width during wrapping and preserves writing on it intact. The PLC 18 controller also controls the function of the swing arm 15 and banner applicator structure 16, and it also directs the final phases of wrapping with the flexible film and over-wrapping the banner film. When the flexible film carriage 12 reaches the bottom of the load 11, PLC 18 actuates rope-making device. Once two strands of the flexible film rope are accumulated; the tail of the film is mechanically secured by having the PLC 18 control the twist wire system or metal ring system.

The twist wire system (not shown) applies a twist tie to fasten the film tail. Alternate methods of tail treatment are available including the metal ring system (not shown).

In a clamp/cut/wipe system, the tail is wiped to the load. Toward the end of the wrapping sequence, as the pallet has been completely wrapped, the end of the film has to be cut and attached to the load, and also the tail has to be held in a manner to be attached to the next load automatically. The system that achieves this is known as clamp/cut/wipe system.

Once the load has been wrapped, and the film-dispensing device, the flexible film applicator 12 (Film Saver), is at the bottom of its travel, the film flow from the Film Saver is seized. At this time, a pair of pneumatically operated arms which work like scissors, clamp the film between the Film Saver and the wrapped load. The clamp arm will not let go of the film until the next cycle. Once the film has been clamped, a cutting arm (not shown) intercepts the film path that connects from the load at one end to the clamp at the other, and cuts the film at close proximity of the clamp device. Now that the film has been severed from the clamp, and the source, a set of rollers, a piece(s) of flexible rubber pad or a brush, wipe the loose (tail) end of the film to the load. This concludes the clamp/cut/wipe sequence. At this time, the load will travel away from the wrap zone.

A clamp/cut system is the same as clamp/cut/wipe system with the exception that instead of a wipe action, a heated bar attaches the tail end of the film to the load. This achieves a more positive tail treatment than just a wipe action that does not prevent unraveling of film tail during shipping or storage.

A clamp/cut system is the same as clamp/cut/wipe system with the exception that after clamping and cutting, no further steps are taken. The tail either hangs or is held to the load by the snap action of film being cut under tension.

A hog/ring/applicator system functions in the same manner as the twist wire system described herein. The difference is that instead of the twist tie device application, a metal ring (Hog Ring) device application is inserted to hold the end of the film rope to the load.

A knot tying system utilizes a clamp device to hold the end of the film for the next cycle. The mechanism creates a roped tail and mechanically ties a knot with the roped film creating a positive fastening of the film tail to the load.

Although the present invention has been explained hereinabove by way of a preferred embodiment thereof, it should be pointed out any modification to this preferred embodiment within the scope of the appended claims is not deemed to alter or change the nature and scope of the present invention.

In summary, the instant invention comprises an apparatus for wrapping a pallet load having vertical sides and upper edges defining upper corners and lower edges defining lower corners wherein the load is wrapped with a flexible stretchable film and wherein the load is over-wrapped with a relatively unstretchable unstretched banner film and the unstretched banner film is over-wrapped with the stretchable film, the apparatus, in combination, comprising: (a) device for supporting the pallet load in an elevated position, in which each corner of the pallet load is exposed, (b) a support structure disposed in a fixed position above the pallet load, (c) one rotary wrapper swing arm supported by the supporting structure said arm rotatably driven about a vertical axis of the pallet load, the rotary arm disposed above the pallet in a rotatable position of the rotary arm, (d) two upright towers supported from the rotary arm outwardly spaced from the pallet load in a rotating position of the rotary arm, (e) one supply source for a flexible, stretchable film and one supply source for a banner film mounted to each of two upright towers, each supply source driven in an upward direction and downward direction along each upright tower, (f) device for driving the rotary arm rotatably about the vertical axis such that each upright tower sweeps a path around the pallet load, (g) device for driving each supply source selectively in an upward direction on each upright tower and in a downward direction on each upright tower, (h) device for applying the flexible film as a film sheet and selectively as a film rope in which the wrapping film is bunched into a rope-like configuration, (i) device for applying the relatively unstretchable unstretched banner film as a film sheet in which the banner film remains at full width, (j) clamping devices for clamping the banner film, (k) fastening devices for fastening the film tail of said flexible stretchable film to said pallet load, (l) attaching device for attaching the banner film to the stretch film, (m) cutting devices for cutting the attached banner film, (n) roping device, (o) device for mechanically securing the tail of the flexible stretchable film to the load, and (p) programmable logic controller (PLC) connected to and controlling said supply source for the flexible film, and to said supply source for the less flexible unstretched banner film, said rotary wrapper swing arm, said device for applying the flexible film as a film sheet and selectively as a rope, said device for applying the relatively unstretchable unstretched banner film as a film sheet, said clamping device for clamping and cutting the banner film, said fastening device for fastening the film, said attaching device for attaching the banner film to the stretch film, said roping device and said device for mechanically securing the tail or the stretchable film to the load.

In addition, the instant invention comprises a device wherein:

(a) said supply source for the flexible film is mounted in a carriage controlled to move vertically,
(b) said supply source for the less flexible unstretched banner film is mounted in a carriage controlled to move vertically,
(c) the attaching device for attaching the banner film to the stretch film is a banner applicator,
(d) the cutting device is hot wire,
(e) the flexible film is a polyolefin,
(f) the flexible film is polyethylene,
(g) the banner film is unstretched polyolefin,
(h) the banner film is unstretched polyethylene,
(i) the device for mechanically securing the tail of the flexible stretchable film to the load is a twist wire system,
(j) the device for mechanically securing the tail of the flexible stretch film to the load is a clamped cut wire system wherein the tail is wiped to the load,
(k) the device for mechanically securing the tail of the flexible stretch film to the load is a clamped cut wire system wherein heated bar attaches the tail end of the flexible stretch film to the load, and
(l) the device for mechanically securing the tail of the flexible stretchable film comprises a metal ring inserted to hold the end of the flexible stretchable film rope to the load.

In further addition, the instant invention comprises a wrapping apparatus for wrapping load with flexible stretch film and banner film on which are printed graphics which comprise devices for applying unstretched banner film on the load wrapped with flexible film without distorting the graphics on the banner film.

In further summary, the instant invention comprises a method for wrapping a pallet load with a flexible stretch film and then with a relatively unstretchable unstretched banner film and wrapping the banner film with the flexible film, said method comprising: (a) wrapping the load with a flexible stretch film, and once the load has been wrapped with an attached tail, then wrapping the banner film by attaching the banner film to the wrapped flexible film, (b) over-wrapping the flexible film with the unstretched banner film, with one rotation around the load, (c) attaching the tail of the banner film to the load, (d) severing the attached tail of the banner film from the supply source, (e) over-wrapping the banner film with the flexible stretch film, (f) converting the flexible film into two strands of a rope, and (g) securing the first rope to the load.

What is claimed is:

1. An apparatus for wrapping a pallet load having vertical sides and upper edges defining upper corners and lower edges defining lower corners wherein the load is wrapped with a flexible stretchable film and wherein the load is over-wrapped with a relatively unstretchable banner film and the banner film is over-wrapped with the stretchable film, the apparatus, in combination, comprising:

(a) device for supporting the pallet load in an elevated position, in which each corner of the pallet load is exposed,
(b) a support structure disposed in a fixed position above the pallet load,
(c) one rotary wrapper swing arm supported by the supporting structure said arm rotatably driven about a vertical axis of the pallet load, the rotary arm disposed above the pallet in a rotatable position of the rotary arm,
(d) two upright towers supported from the rotary arm outwardly spaced from the pallet load in a rotating position of the rotary arm,
(e) one supply source for a flexible stretchable film and one supply source for a relatively unstretchable banner film mounted to each of two upright towers, each supply source driven in an upward direction and downward direction along each upright tower,
(f) device for driving the rotary arm rotatably about the vertical axis such that each upright tower sweeps a path around the pallet load,
(g) device for driving each supply source selectively in an upward direction on each upright tower and in a downward direction on each upright tower,
(h) device for applying the flexible stretchable film as a film sheet and selectively as a film rope in which the flexible stretchable film is bunched into a rope-like configuration,
(i) device for applying the relatively unstretchable banner film as a film sheet in which the relatively unstretchable banner film remains at full width,
(j) clamping devices for clamping relatively unstretchable the banner film,
(k) fastening devices for fastening a film tail of said flexible stretchable film to said pallet load,
(l) attaching device for attaching the relatively unstretchable banner film to the flexible unstretchable film,
(m) cutting devices for cutting the attached relatively unstretchable banner film,
(n) roping device,
(o) device for mechanically securing the tail of the flexible stretchable film to the load, and
(p) programmable logic controller (PLC) connected to and controlling said supply source for the flexible stretchable film, and to said supply source for the relatively unstretchable banner film, said rotary wrapper swing arm, said device for applying the flexible stretchable film as a film sheet and selectively as a rope, said device for applying the relatively unstretchable banner film as a film sheet, said clamping device for clamping and cutting the relatively unstretchable banner film, said fastening device for fastening the film tail, said attaching device for attaching the relatively unstretchable banner film to the flexible stretchable film, said roping device and said device for mechanically securing the tail of the flexible stretchable film to the load.

2. The apparatus of claim 1 wherein said supply source for the flexible stretchable film is mounted in a carriage controlled to move vertically.

3. The apparatus of claim 1 wherein said supply source for the relatively unstretchable banner film is mounted in a carriage controlled to move vertically.

4. The apparatus of claim 1 wherein the attaching device for attaching the flexible stretchable banner film to the flexible stretchable film is a banner applicator.

5. The apparatus of claim 1 wherein the cutting device is hot wire.

6. The apparatus of claim 1 wherein the flexible stretchable film is a polyolefin.

7. The apparatus of claim 1 wherein the flexible stretchable film is polyethylene.

8. The apparatus of claim 1 wherein the relatively unstretchable banner film is unstretched polyolefin.

9. The apparatus of claim 1 wherein the relatively unstretchable banner film is unstretched polyethylene.

10. The apparatus of claim 1 wherein the device for mechanically securing the tail of the flexible stretchable film to the load is a twist wire system.

11. The apparatus of claim 1 wherein the device for mechanically securing the tail of the flexible stretchable film to the load is a clamped cut wire system wherein the tail is wiped to the load.

12. The apparatus of claim 1 wherein the device for mechanically securing the tail of the flexible stretchable film to the load is a clamped cut wire system wherein heated bar attaches the tail end of the flexible stretchable film to the load.

13. The apparatus of claim 1 wherein the device for mechanically securing the tail of the flexible stretchable film comprises a metal ring inserted to hold the end of the flexible stretchable film rope to the load.

* * * * *